US009659703B2

(12) United States Patent
Kawai

(10) Patent No.: US 9,659,703 B2
(45) Date of Patent: May 23, 2017

(54) IGNITION COIL FOR INTERNAL COMBUSTION ENGINE

(71) Applicant: DENSO CORPORATION, Kariya, Aichi-pref. (JP)

(72) Inventor: Kazuhide Kawai, Kariya (JP)

(73) Assignee: DENSO CORPORATION, Kariya (JP)

( * ) Notice: Subject to any disclaimer, the term of this patent is extended or adjusted under 35 U.S.C. 154(b) by 88 days.

(21) Appl. No.: 14/837,677

(22) Filed: Aug. 27, 2015

(65) Prior Publication Data

US 2016/0064138 A1 Mar. 3, 2016

(30) Foreign Application Priority Data

Aug. 27, 2014 (JP) ..... 2014-172910

(51) Int. Cl.

| | |
|---|---|
| ***H01F 27/30*** | (2006.01) |
| ***H01F 27/02*** | (2006.01) |
| ***H01F 27/26*** | (2006.01) |
| ***H01F 38/12*** | (2006.01) |
| *H01F 27/32* | (2006.01) |

(52) U.S. Cl.

CPC ..... *H01F 27/263* (2013.01); *H01F 27/306* (2013.01); *H01F 38/12* (2013.01); *H01F 27/325* (2013.01)

(58) Field of Classification Search

CPC ..... H01F 27/325
USPC ..... 336/208
See application file for complete search history.

(56) References Cited

FOREIGN PATENT DOCUMENTS

JP 03-224207 10/1991

*Primary Examiner* — Elvin G Enad
*Assistant Examiner* — Ronald Hinson
(74) *Attorney, Agent, or Firm* — Nixon & Vanderhye P.C.

(57) ABSTRACT

An ignition coil for an internal-combustion engine, including an assembly of a primary coil, a secondary coil, and a central core, and a ring-shaped outer core surrounding the assembly. The assembly includes at least one first protrusion protruding from a first end surface of the secondary spool. The at least one first protrusion is in contact with an inside surface of the outer core and offset from the central core toward an opening of the outer core in a penetration direction of the outer core. The assembly further includes at least one second protrusion protruding from a second end surface of the primary spool. The at least one second protrusion protrudes beyond a second axial end surface of the central core so as to be in contact with the inside surface of the outer core and extends substantially the entire length of the outer core in the penetration direction.

6 Claims, 7 Drawing Sheets

IGNITION COIL FOR INTERNAL COMBUSTION ENGINE

CROSS-REFERENCE TO RELATED APPLICATION

This application is based on and claims the benefit of priority from earlier Japanese Patent Applications No. 2014-172910 filed Aug. 27, 2014, the descriptions of which are incorporated herein by reference.

BACKGROUND

Technical Field

The present invention relates to an ignition coil for an internal-combustion engine for generating an ignition spark at a spark plug.

Related Art

An ignition coil is known that includes an assembly of a primary coil, a secondary coil, and a central core, and a ring-shaped outer core having the assembly inserted therein. In such an ignition coil, an axial end surface of the central core is in contact with an inside surface of the outer core, and a core gap is formed between an opposite axial end surface of the central core and the inside surface of the outer core.

For example, Japanese Patent Application Laid-Open Publication No. 1991-224207 discloses an ignition coil for an internal-combustion engine including a first core having a primary coil and a secondary coil disposed on an outer circumference of a first core and a second core surrounding the first core to form a closed flux path together with the first core. The above disclosed ignition coil has a core gap formed between an axial end surface (referred to as a second axial end surface) of the first core and the second core with an opposite axial end surface (referred to as a first axial end surface) of the first core pressed against a contact surface of the second core. This can prevent a gap between the first axial end surface of the first core and the contact surface of the second core from occurring, thereby preventing degradation in performance of the ignition coil or reducing variations in performance of the ignition coil.

In the ignition coil disclosed in Japanese Patent Application Laid-Open Publication No. 1991-224207, when the assembly of the primary coil, the secondary coil, and the first core is inserted into the second core from an opening of the second core, the assembly may be inserted oblique to the opening of the second core with the first axial end surface of the first core kept in contact with the inside surface of the second core. During insertion of the assembly into the second core, an end surface of a primary spool having the primary coil wound therearound may contact the inside surface of the second core to be abraded until the first axial end surface of the first core becomes in contact with the contact surface of the second core, which may cause variations in abraded quantity of the primary spool. Although the first core is in contact with the second core, tilting of the first core when assembled in the second core may cause variations in amount of magnetic flux passing through the first and second cores, which may degrade the performance of the ignition coil or cause variations in performance of the ignition coil.

In consideration of the foregoing, exemplary embodiments of the present invention are directed to providing an ignition coil for an internal-combustion engine, capable of vertically inserting an assembly of a primary coil, a secondary coil, and a central core into an outer core so that substantially no tilting of the central core when assembled in the outer core occurs.

SUMMARY

In accordance with an exemplary embodiment of the present invention, there is provided an ignition coil for an internal-combustion engine, including: an assembly of a primary coil wound around an outer circumference of a primary spool, a secondary coil wound around an outer circumference of a secondary spool and arranged concentrically on an outer circumference of the primary coil, and a central core disposed on an inner circumference of the primary coil; and a ring-shaped outer core surrounding the assembly of the primary coil, the secondary coil, and the central core, the outer core being in contact with a first axial end surface of the central core and forming a core gap between the outer core and a second axial end surface of the central core, the second axial end surface of the central core being opposite the first axial end surface of the central core. In the ignition coil, the assembly includes: at least one first protrusion protruding from a first end surface of the secondary spool on a first axial end side of the central core, the at least one first protrusion being in contact with an inside surface of the outer core and being offset from the central core toward a second opening of the outer core in a penetration direction of the outer core, the second opening of the outer core being opposite a first opening of the outer core from which the assembly of the primary coil, the secondary coil, and the central core are inserted into an inside of the outer core; and at least one second protrusion protruding from a second end surface of the primary spool opposite the first end surface of the secondary spool in the axial direction of the central core, the at least one second protrusion protruding beyond a second axial end surface of the central core opposite the first axial end surface of the central core in the axial direction of the central core so as to be in contact with the inside surface of the outer core and extending substantially the entire length of the outer core in the penetration direction.

In the above ignition coil, the primary spool is provided with the at least one second protrusion, and the secondary spool is provided with the at least one first protrusion. This can improve the accuracy in positioning of the central core relative to the outer core upon assembling the central core into the outer core.

More specifically, the assembly of the primary coil, the secondary coil, and the central core is guided at both first and second axial ends of the central core at both first and second axial end surface sides of the central core by the at least one second protrusion and the at least one first protrusion to be inserted into the inside of the outer core. The at least one first protrusion is offset from the central core toward the second opening in the penetration direction of the outer core. This allows the at least one first protrusion to contact the inside surface of the outer core before the first axial end surface of the central core contacts the inside surface of the outer core, when the central core is inserted into the outer core. Then, the first axial end surface of the central core contacts the inside surface of the outer core with the at least one first protrusion kept in contact with the inside surface of the outer core.

In addition, the at least one second protrusion extends substantially the entire length of the outer core in the penetration direction. This allows the at least one second protrusion to contact the inside surface of the outer core substantially at the same time as the at least one first protrusion contact the inside surface of the outer core before the first axial end surface of the central core contacts the inside surface of the outer core, when the central core is inserted into the outer core.

As a result, when the central core is assembled into the outer core, the central core is guided at both first and second axial ends of the central core to be inserted into the outer core. This allows the assembly of the primary coil, the secondary coil, and the central core to be vertically inserted into the outer core. Thus, the central core can be assembled into the outer core so that substantially no tilting of the central core when assembled in the outer core occurs.

With the ignition coil configured as above, the assembly of the primary coil, the secondary coil, and the central core can be vertically inserted into the outer core, and the central core can be assembled into the outer core so that substantially no tilting of the central core assembled in the outer core occurs. This can prevent degradation in performance of the ignition coil or can reduce variations in performance of the ignition coil.

DESCRIPTION OF SPECIFIC EMBODIMENTS

Example embodiments will now be described more fully with reference to the accompanying drawings. Example embodiments are provided so that this disclosure will be thorough, and will fully convey the scope to those who are skilled in the art. Numerous specific details are set forth such as examples of specific components to provide a thorough understanding of embodiments of the present disclosure. It will be apparent to those skilled in the art that example embodiments may be embodied in many different forms and that neither should be construed to limit the scope of the disclosure. The labels "first" and "second" as used herein are merely used as differentiators and are not meant to imply a particular order.

First Embodiment

Figure 1:
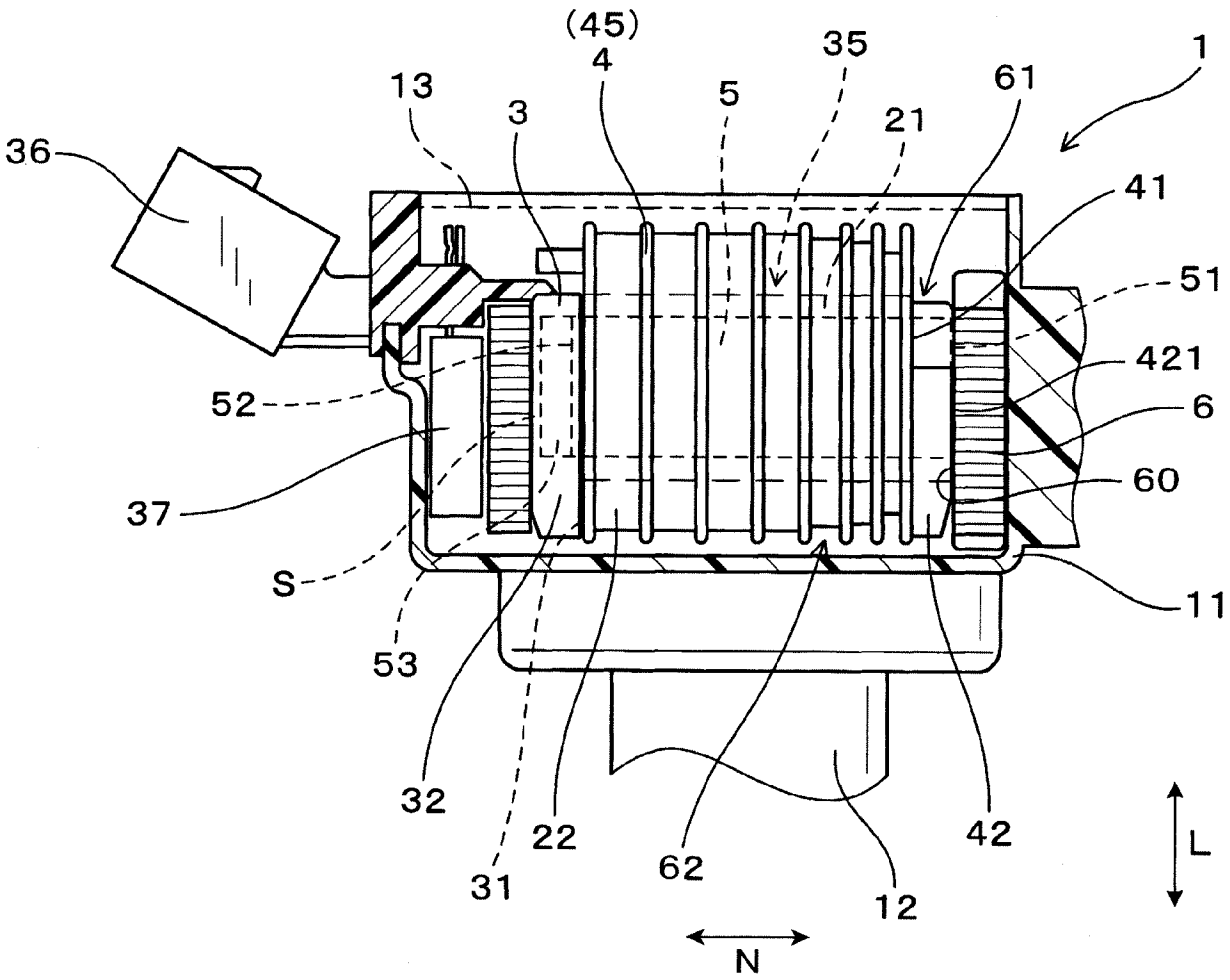
FIG. 1 is a cross-sectional view of an ignition coil in accordance with a first embodiment of the present invention.
Figure 2:
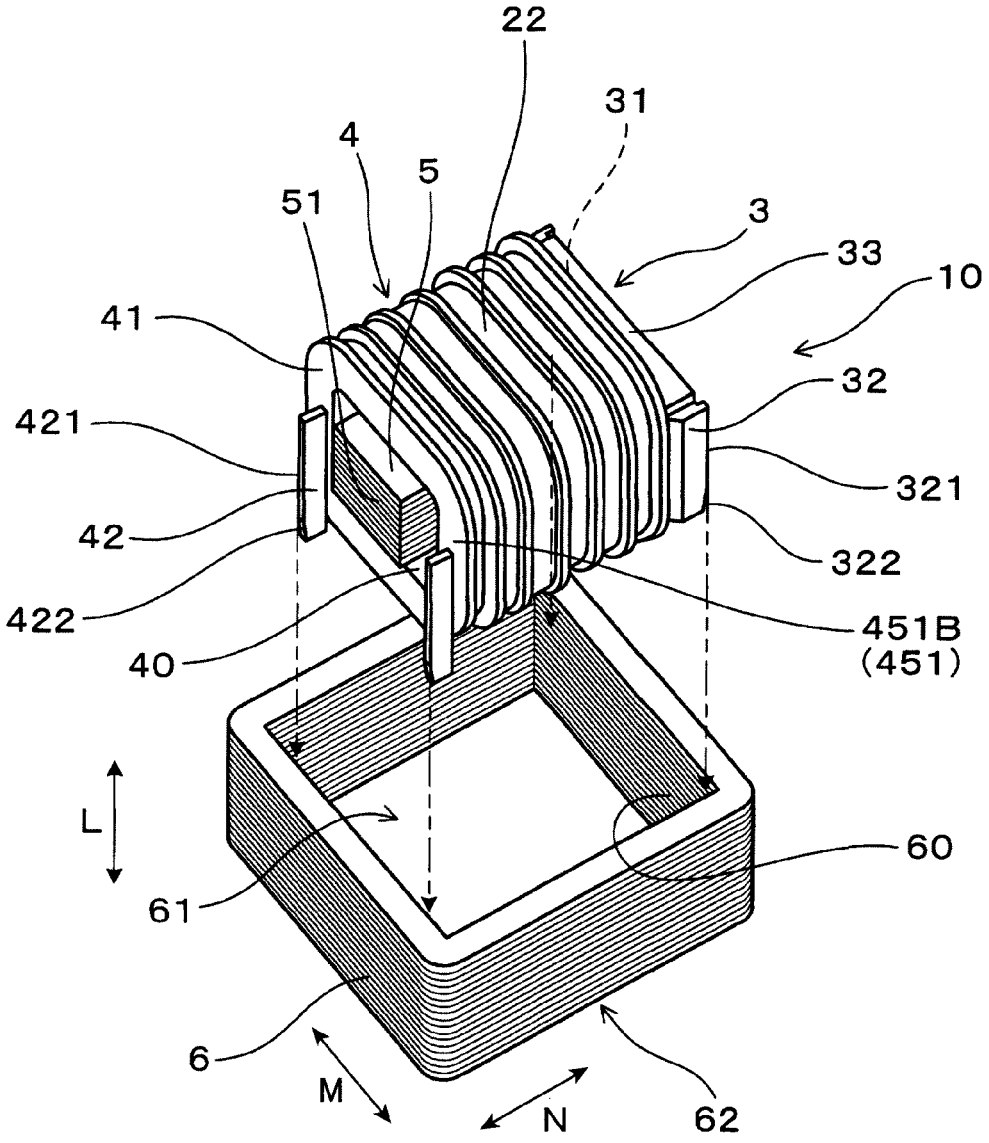
FIG. 2 is a perspective view illustrating assembling an assembly of a primary coil, a secondary coil and a central core into an outer core as viewed from a first-protrusion side of the assembly, in accordance with the first embodiment.
Figure 3:
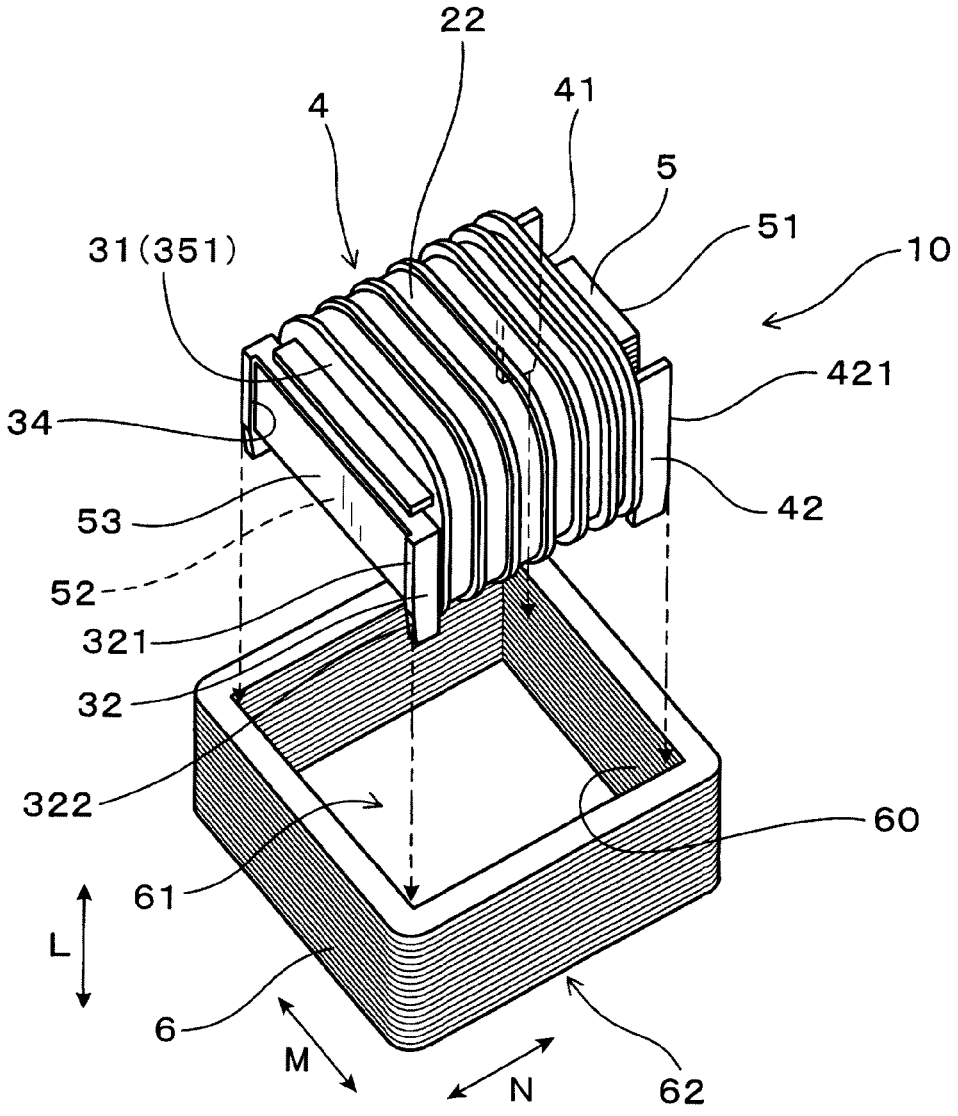
FIG. 3 is a perspective view illustrating assembling the assembly into the outer core as viewed from a second-protrusion side of the assembly, in accordance with the first embodiment.

An ignition coil 1 for an internal-combustion engine, as shown in FIGS. 1-3, includes a primary coil 21 wound around an outer circumference of a primary spool 3, a secondary coil 22 wound around an outer circumference of a secondary spool 4 and arranged concentrically on an outer circumference of the primary coil 21, a central core 5 disposed on an inner circumference of the primary coil 21, and a ring-shaped outer core 6 surrounding the primary coil 21, the secondary coil 22, and the central core 5. A first axial end surface 51 of the central core 5 is in contact with an inside surface 60 of the outer core 6. A core gap S is formed between a second axial end surface 52 of the central core 5 and the inside surface 60 of the outer core 6, where the second axial end surface 52 of the central core 5 is opposite the first axial end surface 51 of the central core 5. The ignition coil 1 is formed by inserting an assembly 10 of the primary coil 21, the secondary coil 22, and the central core 5 into the inside of the outer core 6 from a first opening 61 of the outer core 6 in a penetration direction L of the outer core 6.

As shown in FIG. 2, a first end surface 41 of the secondary spool 4 is provided with a pair of first protrusions 42 protruding from the first end surface 41. End surfaces 421 of the first protrusions 42 are flush with the first axial end surface 51 of the central core 5 so as to contact the inside surface 60 of the outer core 6 when the assembly is inserted into the inside of the outer core 6. The first protrusions 42 are offset from the central core 5 toward a second opening 62 of the outer core 6 opposite the first opening 61 of the outer core 6 in a penetration direction L of the outer core 6.

As shown in FIG. 3, a second end surface 31 of the primary spool 3 opposite the first end surface 41 of the secondary spool 4 is provided with a pair of second protrusions 32 protruding from the second end surface 31. The second protrusions 32 protrude beyond the second axial end surface 52 of the central core 5 in the axial direction N of the central core 5 (see, for example, FIG. 1) so that end surfaces 321 of the second protrusions 32 can contact the inside surface 60 of the outer core 6 when the assembly is inserted into the inside of the outer core 6. The second protrusions 32 are arranged in laterally opposed positions and extend substantially the entire length of the outer core 6 in the penetration direction L. That is, the second protrusions 32 are opposed in a lateral direction M that is perpendicular to both the penetration direction L and the axial direction N.

The ignition coil 1 of the present embodiment will now be explained with reference to FIGS. 1-6.

As shown in FIG. 1, the ignition coil 1 is provided for each cylinder of the engine to generate a sparking voltage for generating a spark at a spark plug inserted in a plug hole of the cylinder.

In the ignition coil 1, the primary coil 21, the secondary coil 22, the central core 5 and the outer core 6 are disposed outside the plug hole, and a joint portion 12 to the spark plug is disposed inside the plug hole. The primary coil 21, the secondary coil 22, the central core 5, and the outer core 6 are disposed in the casing 11. Clearances within the casing 11 are filled with a casting resin 13.

The central core 5 is cuboid-shaped. The primary coil 21 is wound around the outer circumference of the primary spool 3 having a substantially quadrilateral-cylinder-shaped cross section with rounded corners. The secondary coil 22 is wound around the outer circumference of the secondary spool 4 having a substantially quadrilateral-cylinder-shaped cross section with rounded corners. The outer core 6 is substantially rectangular-ring-shaped with rounded corners. The penetration direction L of the outer core 6 is directed to an opening of the casing 11, where the casing 11 is a cuboid vessel shaped to follow the contours of the rectangular-ring-shaped outer core 6.

Each of the central core 5 and the outer core 6 is a stack of a plurality of magnetic steel plates stacked in the penetration direction L. The primary spool 3 includes a cylindrical tube 35 having the primary coil 21 wound therearound and a connector 36 connected to one of ends of the cylindrical tube 35. An igniter 37 is disposed within the casing 11 and outside the outer core 6 and connected to the connector 36. The secondary spool 4 includes a cylindrical tube 45 having the secondary coil 22 wound therearound. The secondary spool 4 has a hollow bore 40 centrally formed therein, where the primary coil 21 and the central core 5 inserted in the hollow bore 40.

The connector 36 is not shown in FIGS. 2 and 3 for simplicity.

As shown in FIG. 2, the first protrusions 42 protrude from the first end surface 41 of a collar 451 provided at a first axial end of the cylindrical tube 45 of the secondary spool 4. The first protrusions 42 are formed on side segments 451B of the collar 451 of the secondary spool 4 on both lateral sides of the hollow bore 40 and extend in the penetration direction L. Second-opening 62 side end portions of the first protrusions 42 are tapered, providing tapered portions 422 to guide the assembly 10 into the inside of the outer core 6. The first protrusions 42 are arranged in substantially laterally symmetrical positions about the central core 5.

A length from the pair of end surfaces 421 of the first protrusions 42 to the pair of end surfaces 321 of the second protrusions 32 is a little bit greater than an inside surface to surface distance of the outer core 6.

As shown in FIG. 3, the second protrusions 32 protrude from the second end surface 31 of a collar 351 provided at a second axial end of the cylindrical tube 35 of the primary spool 3. The second protrusions 32 are formed at both lateral edges of the collar 351 of the primary spool 3 and extend in the penetration direction L. Second-opening 62 side end portions of the second protrusions 32 are tapered, providing tapered portions 322 to guide the assembly 10 into the inside of the outer core 6.

The second protrusions 32 are provided in substantially laterally symmetrical positions about the central core 5. The pair of second protrusions 32 and a web 33 connecting the second protrusions 32 at their first-opening 61 side form a receiving portion 34 for receiving a permanent magnet 53 therein. The permanent magnet 53 is disposed adjacent to the core gap S and on the second axial end surface 52 of the central core 5 to generate a magnetic flux in a direction opposite a direction of a flux magnetic flux formed in the central core 5, thereby improving performance of the ignition coil 1.

Modifications

Several modifications to the first embodiment will now be explained with reference to FIGS. 4-6. In these modifications, components of the ignition coil 1 other than the first protrusions 42 are same as the those of the first embodiment described above.

First Modification

Figure 4:
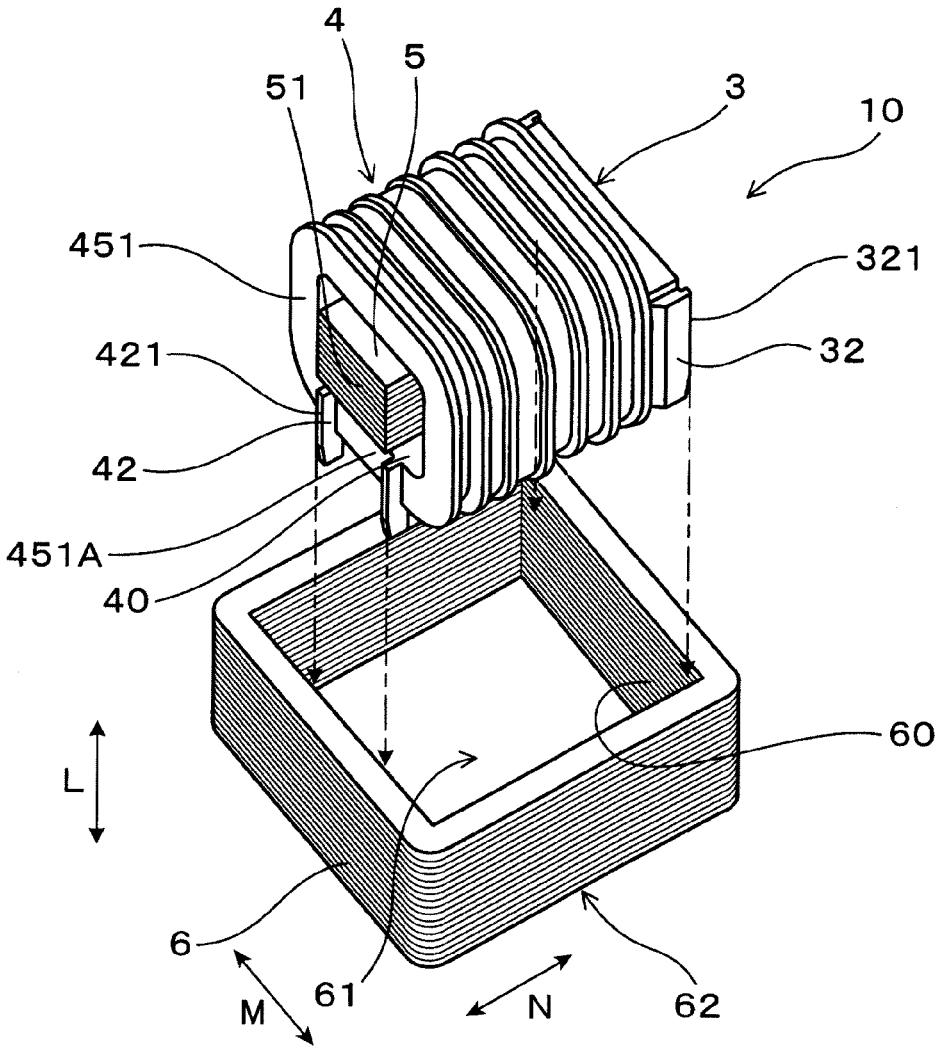
FIG. 4 is a perspective view illustrating assembling the assembly into the outer core as viewed from a first-protrusion side of the assembly, in accordance with a first modification to the first embodiment.

As shown in FIG. 4, a pair of first protrusions 42 may be formed at lateral ends of a side segment 451A of the collar 451 of the secondary spool 4 on the second-opening 62 side of the hollow bore 40 and extend in the penetration direction L, where the side segment 451A of the collar 451 of the secondary spool 4 extends in a lateral direction perpendicular to the penetration direction L. In such a configuration, the first protrusions 42 may be positioned on the second-opening 62 side of the central core 5.

Second Modification

Figure 5:
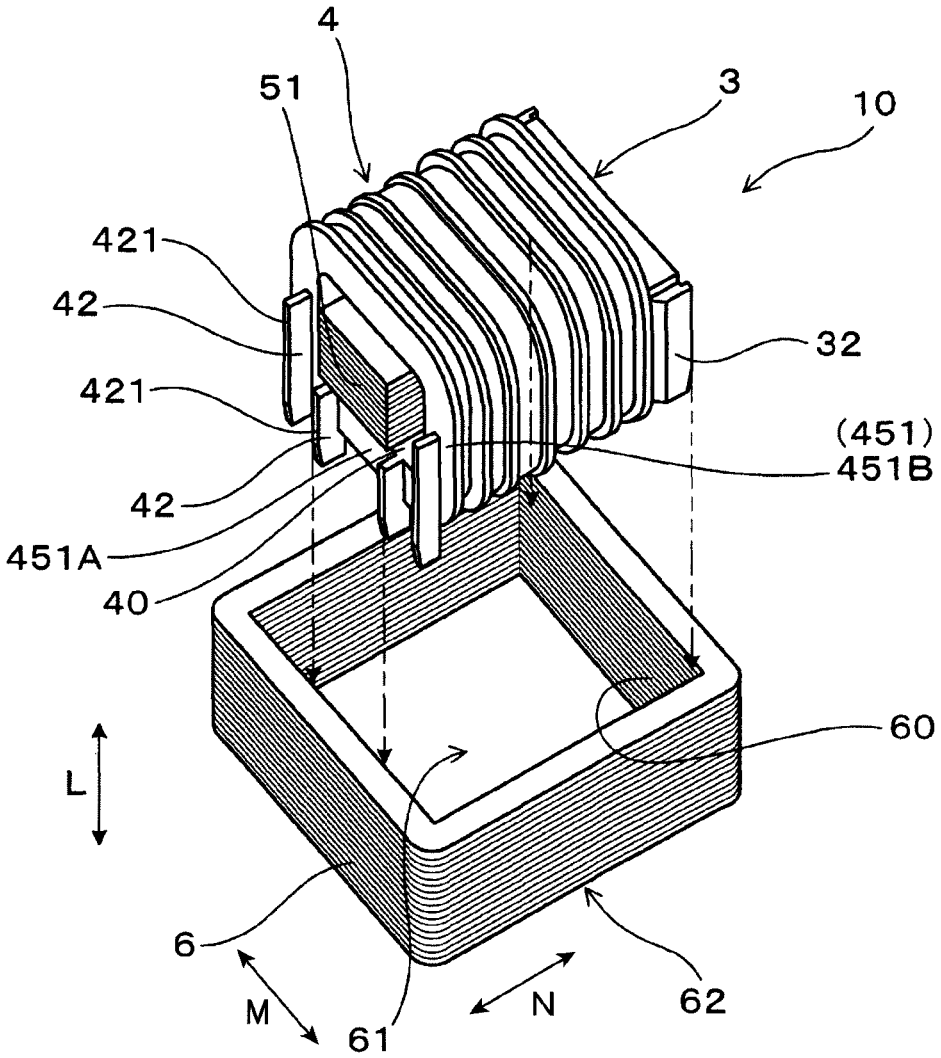
FIG. 5 is a perspective view illustrating assembling the assembly into the outer core as viewed from a first-protrusion side of the assembly, in accordance with a second modification to the first embodiment.

As shown in FIG. 5, a first pair of first protrusions 42 may be formed at lateral ends of the side segment 451A of the collar 451 of the secondary spool 4 on the second-opening 62 side of the hollow bore 40 and extend in the penetration direction L, and a second pair of first protrusions 42 may be formed on the side segments 451A of the collar 451 of the secondary spool 4 on the lateral sides of the hollow bore 40 and extend in the penetration direction L. In such a configuration, the axial end surfaces 421 of the first and second pairs of first protrusions 42 may be flush with the axial end surface 51 of the central core 5.

Third Modification

Figure 6:
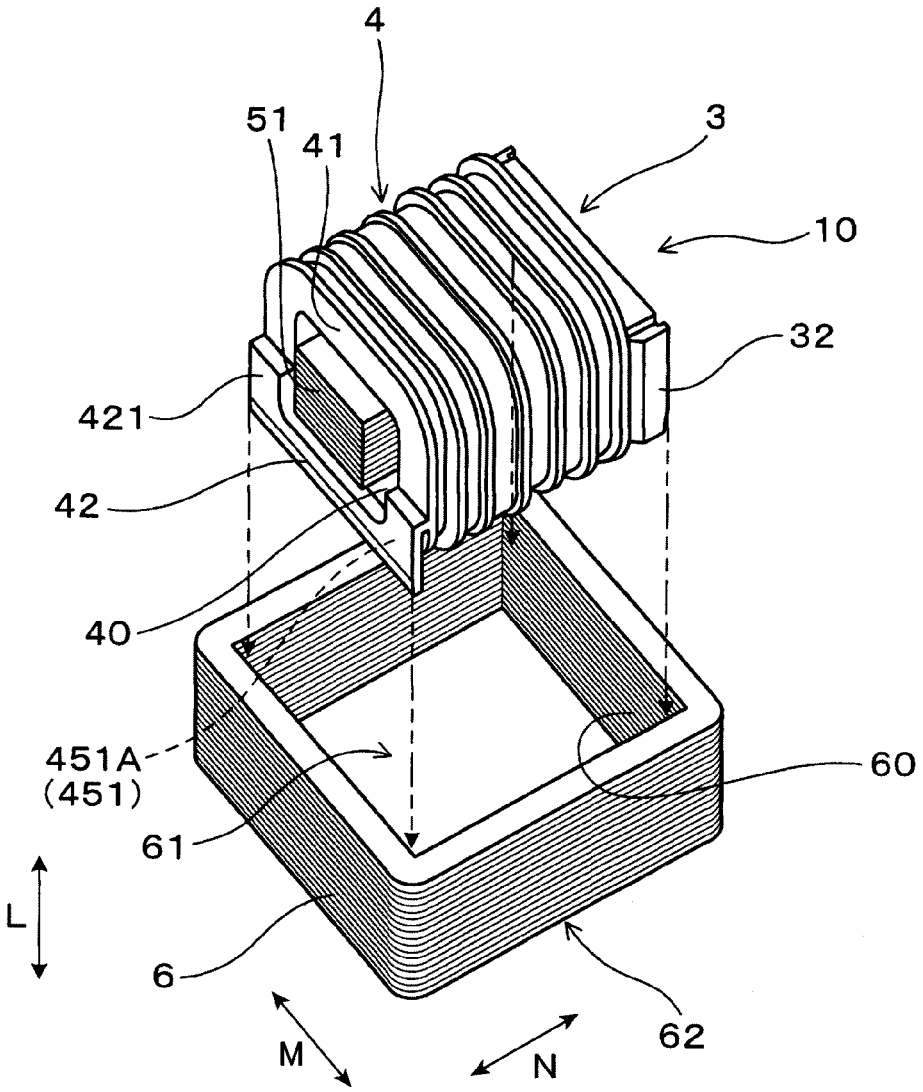
FIG. 6 is a perspective view illustrating assembling the assembly into the outer core as viewed from a first-protrusion side of the assembly, in accordance with a third modification to the first embodiment.

As shown in FIG. 6, a first protrusion 42 may not only extend in the penetration direction L, but also extend the entire length of the side segment 451A of the collar 451 of the secondary spool 4 on the second-opening 62 side of the hollow bore 40. In such a configuration, the first protrusion 42 may be formed such that the side segment 451A of the collar 451 of the secondary spool 4 is offset from the first end surface 41 of the secondary spool 4 in the axial direction N so as to be flush with the axial end surface 51 of the central core 5.

In the ignition coil 1 of the present embodiment, as above, the primary spool 3 is provided with the second protrusions 32, and the secondary spool 4 are provided with the first protrusions 42. This can improve the accuracy in positioning of the central core 5 in the outer core 6 when assembled into the outer core 6.

More specifically, the assembly 10 of the primary coil 21, the secondary coil 22, and the central core 5 is guided at both first and second axial ends of the central core 5 by the second protrusions 32 and the first protrusions 42 to be inserted into the inside of the outer core 6. The first protrusions 42 are offset from the central core 5 toward the second opening 62 of the outer core 6 in the penetration direction L. This allows the first protrusions 42 to contact the inside surface 60 of the outer core 6 before the first axial end surface 51 of the central core 5 contacts the inside surface 60 of the outer core 6, when the central core 5 is inserted into the outer core 6. Then, the first axial end surface 51 of the central core 5 contacts the inside surface 60 of the outer core 6 with the first protrusions 42 kept in contact with the inside surface 60 of the outer core 6.

The second protrusions 32 are arranged in laterally opposed positions and extend substantially the entire length of the outer core 6 in the penetration direction L. This allows the second protrusions 32 to contact the inside surface 60 of the outer core 6 substantially at the same time as the first protrusions 42 contact the inside surface 60 of the outer core 6 before the first axial end surface 51 of the central core 5 contacts the inside surface 60 of the outer core 6, when the central core 5 is inserted into the outer core 6.

As a result, when the central core 5 is assembled into the outer core 6, the central core 5 is guided at both first and second axial ends of the central core 5 to be inserted into the outer core 6. This allows the assembly 10 of the primary coil 21, the secondary coil 22, and the central core 5 to be inserted into the outer core 6 with the assembly 10 kept in a vertical position to the first opening 61 of the outer core 6. Thus, the central core 5 can be assembled into the outer core 6 so that substantially no tilting of the central core 5 when assembled in the outer core 6 occurs, which can reduce variations in amount of magnetic flux passing through the central core 5 and the outer core 6.

Therefore, with the ignition coil 1 of the present embodiment, the assembly 10 of the primary coil 21, the secondary coil 22, and the central core 5 can be vertically inserted into the outer core 6 so that substantially no tilting of the central core 5 when assembled in the outer core 6 occurs. This can reduce variations in performance of the ignition coil 1. Preventing degradation in performance of the ignition coil 1 or reducing variations in performance of the ignition coil 1 can reduce a margin of performance, thereby achieving cost savings or downsizing of the ignition coil 1.

Second Embodiment

Figure 7:
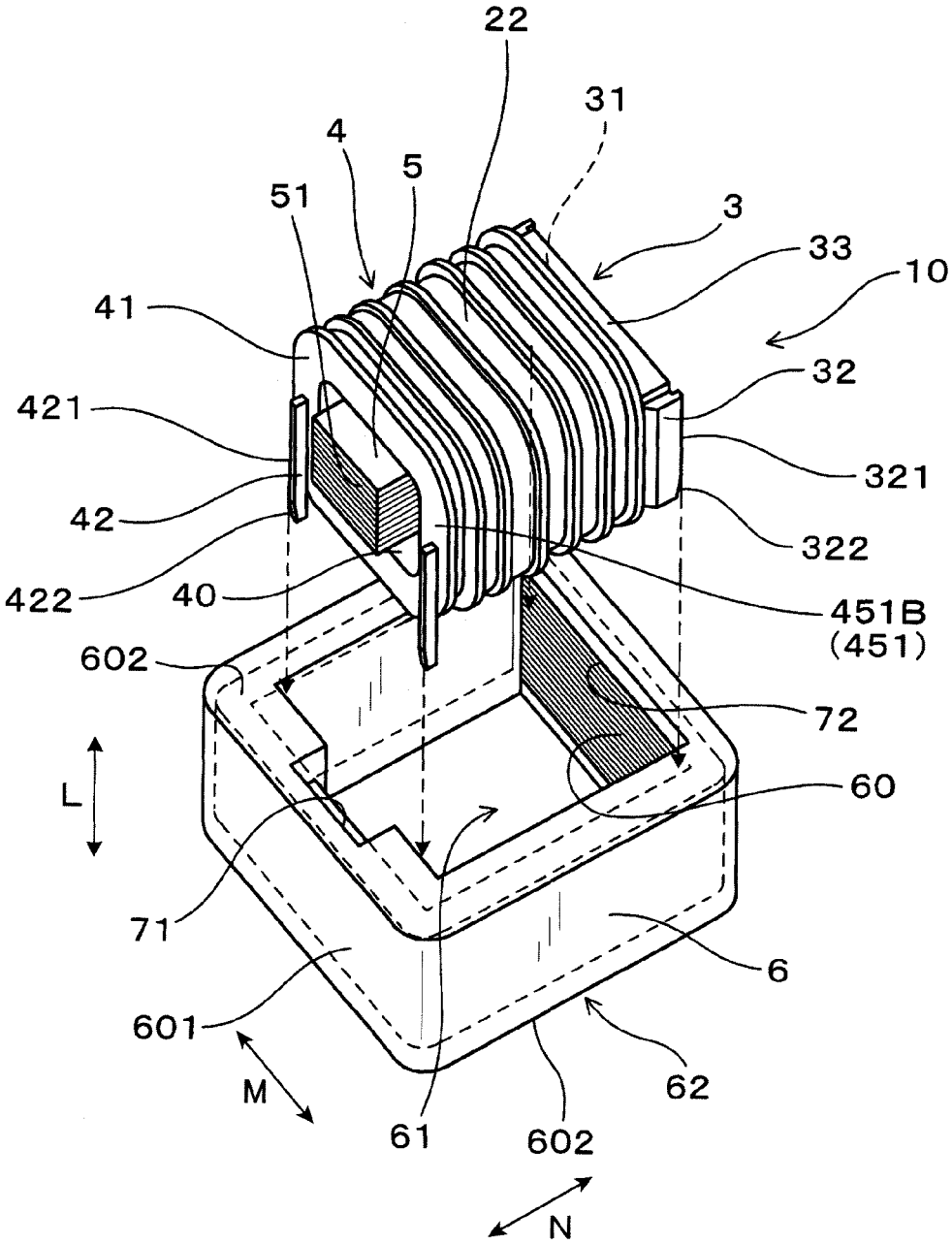
FIG. 7 is a perspective view illustrating assembling an assembly of a primary coil, a secondary coil and a central core into an outer core as viewed from a first-protrusion side of the assembly, in accordance with a second embodiment of the present invention.

The ignition coil 1 of the present embodiment, as shown in FIG. 7, has the outer core 6 covered with a protective member 7.

The protective member 7 covers the inside surface 60 of the outer core 6, and an outside surface 601, and end surfaces 602 in the penetration direction L. The protective member 7 has cutouts 71, 72 where the inside surface 60 of the outer core 6 is exposed to receive the first and second axial end surfaces 51, 52 of the central core 5. The cutout 71 corresponds to a portion of the inside surface 60 of the outer core 6 that contacts the axial end surface 51 of the central core 5. Portions of the inside surface 60 of the outer core 6 on both lateral sides of the cutout 71 are covered with the protective member 7.

A pair of first protrusions 42 are formed on the first end surface 41 of the collar 451 of the cylindrical tube 45 of the secondary spool 4, where each first protrusion 42 has a height such that the first end surface 421 of the first protrusion 42 can contact the inside surface 70 of the protective member 7. The first protrusions 42 are formed on laterally opposed side segments 451B of the collar 451 of the secondary spool 4 and extend in the penetration direction L. Second-opening 62 side end portions of the first protrusions 42 are tapered, providing tapered portions 422 to guide the assembly 10 into the inside surface 70 of the protective member 7. The first protrusions 42 are provided in substantially laterally symmetrical positions about the central core 5.

In the present embodiment, when the central core 5 is inserted into the outer core 6 covered with the protective member 7, the first protrusions 42 contact the inside surface 70 of the protective member 7 before the first axial end surface 51 of the central core 5 contacts the exposed inside surface 60 of the outer core 6. Then, the first axial end surface 51 of the central core 5 contacts the inside surface 60 of the outer core 6 with the first protrusions 42 kept in contact with the inside surface 70 of the protective member 7.

The pair of second protrusions 32, as in the first embodiment, are arranged in laterally opposed positions and extend substantially the entire length of the outer core 6 in the penetration direction L. This allows the second protrusions 32 to contact the inside surface 60 of the outer core 6 substantially at the same time as the first protrusions 42 contact the inside surface 70 of the protective member 7 before the first axial end surface 51 of the central core 5 contacts the inside surface 60 of the outer core 6, when the central core 5 is inserted into the outer core 6.

Thus, the assembly 10 of the primary coil 21, the secondary coil 22, and the central core 5 can be vertically inserted into the outer core 6, and the central core 5 can be assembled into the outer core 6 so that substantially no tilting of the central core 5 when assembled in the outer core 6 occurs. This can provide similar advantages to those of the first embodiment. In FIG. 7, other elements of the ignition coil 1 having similar functions as in the first embodiment are assigned the same numbers.

What is claimed is:

1. An ignition coil for an internal-combustion engine, comprising:

an assembly of a primary coil wound around an outer circumference of a primary spool, a secondary coil wound around an outer circumference of a secondary spool and arranged concentrically on an outer circumference of the primary coil, and a central core disposed on an inner circumference of the primary coil; and a ring-shaped outer core surrounding the assembly of the primary coil, the secondary coil, and the central core, the outer core being in contact with a first axial end surface of the central core and forming a core gap between the outer core and a second axial end surface of the central core, the second axial end surface of the central core being opposite the first axial end surface of the central core, wherein the assembly comprises:

at least one first protrusion protruding from a first end surface of the secondary spool on a first axial end side of the central core, the at least one first protrusion being in contact with an inside surface of the outer core and being offset from the central core toward a second opening of the outer core in a penetration direction of the outer core, the second opening of the outer core being opposite a first opening of the outer core from which the assembly of the primary coil, the secondary coil, and the central core are inserted into an inside of the outer core; and at least one second protrusion protruding from a second end surface of the primary spool opposite the first end surface of the secondary spool in the axial direction of the central core, the at least one second protrusion protruding beyond a second axial end surface of the central core opposite the first axial end surface of the central core in the axial direction of the central core so as to be in contact with the inside surface of the outer core and extending substantially the entire length of the outer core in the penetration direction.

2. The ignition coil of claim 1, wherein the secondary spool has a hollow bore formed centrally in the secondary spool, the hollow bore having the primary coil and the central core inserted in the bore, the at least one first protrusions comprises a pair of first protrusions, the pair of first protrusions being formed on side segments of the first end surface of the secondary spool on both lateral sides of the hollow bore and extending in the penetration direction of the outer core, and the at least one second protrusions comprises a pair of second protrusions, the pair of second protrusions being formed at both lateral edges of the second end surface of the primary spool and extend in the penetration direction.

3. The ignition coil of claim 1, wherein the secondary spool has a hollow bore formed centrally in the secondary spool, the hollow bore having the primary coil and the central core inserted in the bore, the at least one first protrusions comprises a pair of first protrusions, the pair of first protrusions being formed at both lateral ends of a side segment of the first end surface of the secondary spool on a second-opening side of the hollow bore, and extending in the penetration direction of the outer core, and the at least one second protrusions comprises a pair of second protrusions, the pair of second protrusions being formed at both lateral edges of the second end surface of the primary spool and extend in the penetration direction.

4. The ignition coil of claim 1, wherein the secondary spool has a hollow bore formed centrally in the secondary spool, the hollow bore having the primary coil and the central core inserted in the bore, the at least one first protrusions comprises first and second pairs of first protrusions, the first pair of first protrusions being formed at both lateral ends of a side segment of the first end surface of the secondary spool on a second-opening side of the hollow bore, and extending in the penetration direction of the outer core, and the second pair of first protrusions being formed on side segments of the first end surface of the secondary spool on both lateral sides of the hollow bore and extending in the penetration direction of the outer core, and the at least one second protrusions comprises a pair of second protrusions, the pair of second protrusions being formed at both lateral edges of the second end surface of the primary spool and extend in the penetration direction.

5. The ignition coil of claim 1, wherein the secondary spool has a hollow bore formed centrally in the secondary spool, the hollow bore having the primary coil and the central core inserted in the bore, the at least one first protrusion comprises a single first protrusion, the single first protrusion extending toward the second opening of the outer core in the penetration direction of the outer core and further extending the entire length of a side segment of the first end surface of the secondary spool on a second-opening side of the hollow bore, and the at least one second protrusions comprises a pair of second protrusions, the pair of second protrusions being formed on side segments of the collar of the primary spool on both lateral sides of the hollow bore and extending in the penetration direction of the outer core.

6. An ignition coil for an internal-combustion engine, comprising:

an assembly of a primary coil wound around an outer circumference of a primary spool, a secondary coil wound around an outer circumference of a secondary spool and arranged concentrically on an outer circumference of the primary coil, and a central core disposed on an inner circumference of the primary coil; and a ring-shaped outer core surrounding the assembly of the primary coil, the secondary coil, and the central core, the outer core being in contact with a first axial end surface of the central core and forming a core gap between the outer core and a second axial end surface of the central core, the second axial end surface of the central core being opposite the first axial end surface of the central core, wherein the assembly comprises:

at least one first protrusion protruding from a first end surface of the secondary spool on a first axial end side of the central core, the at least one first protrusion being in contact with an inside surface of a protective member partially covering the outer core and being offset from the central core toward a second opening of the outer core in a penetration direction of the outer core, the second opening of the outer core being opposite a first opening of the outer core from which the assembly of the primary coil, the secondary coil, and the central core are inserted into an inside of the outer core; and at least one second protrusion protruding from a second end surface of the primary spool opposite the first end surface of the secondary spool in the axial direction of the central core, the at least one second protrusion protruding beyond a second axial end surface of the central core opposite the first axial end surface of the central core in the axial direction of the central core so as to be in contact with the inside surface of the outer core and extending ending substantially the entire length of the outer core in the penetration direction.

* * * * *